United States Patent [19]

Takada et al.

[11] 4,385,339

[45] May 24, 1983

[54] FUEL INJECTOR FOR AN INTERNAL COMBUSTION ENGINE

[75] Inventors: Shigetaka Takada, Obu; Akira Tokuda, Nagoya, both of Japan; Yoshiro Iwama, 11-66, Aza Jiodani, Hinaga, Chita-shi, Aichi-ken, Japan

[73] Assignees: Aisan Kogyo Kabushiki Kaisha, Obu; Yoshiro Iwama, Chita, both of Japan

[21] Appl. No.: 204,793

[22] Filed: Nov. 7, 1980

[30] Foreign Application Priority Data

Dec. 4, 1979 [JP] Japan ..... 54-157850

[51] Int. Cl.[3] ..... H01H 47/04

[52] U.S. Cl. ..... 361/154; 239/585; 251/139

[58] Field of Search ..... 361/154; 239/585; 251/139

[56] References Cited

U.S. PATENT DOCUMENTS

| | | | |
|---|---|---|---|
| 3,731,881 | 5/1973 | Dixon et al. | 251/139 |
| 3,786,314 | 1/1974 | Misch | 361/154 |
| 3,934,816 | 1/1976 | Terrell | 335/229 |
| 4,148,090 | 4/1979 | Kawai et al. | 361/154 |
| 4,187,987 | 2/1980 | Raue | 239/585 |
| 4,264,040 | 4/1981 | Saito | 239/585 |
| 4,299,252 | 11/1981 | Reinicke | 335/229 |
| 4,319,211 | 3/1982 | Ueda | 335/229 |

FOREIGN PATENT DOCUMENTS 639126 3/1962 Italy .

*Primary Examiner*—G. Z. Rubinson
*Assistant Examiner*—L. Schroeder
*Attorney, Agent, or Firm*—Blair, Brown & Kreten

[57] ABSTRACT

A method of driving a valve in an injector for an internal combustion engine which intermittently injects liquid fuel by the valve reciprocally moving by attraction force of a solenoid coil and repulsive force of a spring and an apparatus for carrying out the method. An armature secured to the valve to be attracted by the solenoid coil and/or an iron core of the solenoid coil is made of a permanent magnet. The pulse shape of an electric current to be applied to the solenoid coil is made in the form of a stepped wave in which the electric power in the initial stage of application is larger than that in the later stage. An inverse pulse for inversely exciting the solenoid coil is formed to give the permanent magnet of the armature repulsive force upon fall of the pulse wave of the electric current applied to the solenoid coil.

5 Claims, 12 Drawing Figures

FUEL INJECTOR FOR AN INTERNAL COMBUSTION ENGINE

SUMMARY OF THE INVENTION

The object of the present invention is to provide a method and an apparatus for smoothly driving a valve in a fuel injector and for easily measuring small amount of the fuel even under high-speed engine operation.

According to the present invention, there is provided an apparatus for driving a valve in an injector adapted to intermittently inject liquid fuel by the valve which is reciprocally moved by attraction force of an exciting coil and repulsive force of a spring, in which an armature secured to the valve to be attracted by the exciting coil and/or an iron core of the exciting coil is made of a permanent magnet.

Consequently, inductance of the solenoid is decreased without changing the way of winding of the exciting coil to facilitate quick attraction of the armature and measurement of small amount of the fuel injected by the injector.

According to the present invention, there is also provided a method of driving a valve in an injector in which the pulse shape of an electric current applied to the exciting coil in the aforementioned apparatus is formed in a stepped wave shape in which at least the electric current in the initial stage of application is larger than that in the later stage.

Consequently, consumption of electricity in the exciting coil is remarkably reduced and attraction characteristic of the armature is improved.

According to the present invention, there is further provided a method of driving a valve in an injector in which an inverse pulse for inversely exciting the exciting coil is formed to give the permanent magnet of the armature repulsive force upon fall of the pulse wave of the aforementioned electric current applied to the exciting coil.

Consequently, return characteristic of the armature is improved to remarkably raise the aforementioned response of the injector and prevent defective operation of the injector that may be caused by a mechanical accident.

DESCRIPTION OF THE PREFERRED EMBODIMENTS

Figure 1:
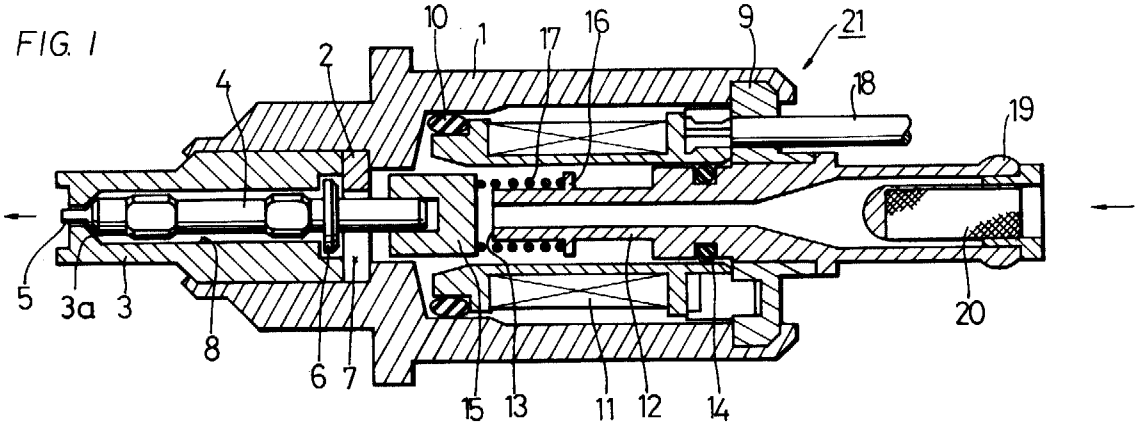
FIG. 1 is a longitudinal sectional view of a fuel injector to which an apparatus according to the present invention is applied.

Referring now to FIG. 1 of the drawings, there is shown an injector 21 of which body 1 is made of non-magnetic material such as resin and aluminum. The body 1 is fitted at its forward end with a valve housing 3 through a retainer 2. Within the valve housing 3, there is provided a valve 4 which is limitedly movable in the axial direction between the end surface of the retainer 2 and a funnel-shaped inner surface 3*a* of the forward end of the valve housing 3 adjacent to an injection port 5 formed thereby. When the valve 4 moves toward the injection port 5 so that the forward end of the valve 4 is in close contact with the funnel-shaped inner surface 3*a* of the housing 3 communicating with the injection port 5, the injection port 5 is closed to stop injection of fuel therefrom. On the other hand, when the valve 4 moves toward the retainer 2 so that a flange 6 in the rear portion of the valve 4 is in contact with the end surface of the retainer 2, the injection port 5 is opened to inject fuel therefrom, which is fed through a channel 7 formed in the retainer 2 and a clearance 8 enclosing the valve 4.

A solenoid coil 11 is mounted in the injector body 1 through a cap 9 and an O-ring 10 for preventing leakage of the fuel. The solenoid coil 11 receives through another O-ring 14 for preventing leakage a fixed iron core 12 which is made of ferromagnetic material and serves as a fuel supplying pipe. A part of the fixed iron core 12, which is inserted into the solenoid coil 11 along the effective length thereof, is sized small in outer diameter so as to decrease inductance of the solenoid coil 11. The inductance of the solenoid coil 11 may also be decreased by making the end portion 13 of the fixed iron core 12 tapered, i.e., making its end surface 13 small for controlling magnetic force.

The valve 4 is provided at its rear end with an armature 15 made in the form of a plunger by a permanent magnet, which is attracted by the fixed iron core 12 upon excitation of the solenoid coil 11. A return spring 17 is interposed between a flange 16 integrally provided with the fixed iron core 12 and the armature 15 to urge the armature 15 and the valve 4 against attraction of the fixed iron core 12 so that the forward end of the valve 4 is in contact with the funnel-shaped inner surface 3*a* of the forward end of the valve housing 3. Numeral 18 indicates a cord for external wiring which is drawn out from the solenoid coil 11 through the cap 9.

Therefore, while the solenoid coil 11 is not excited, the fuel is never injected from the injection port 5 since the port 5 is closed by virtue of the force of the return spring 17 even when the fuel is supplied under pressure to the injector 21 from a fuel supplier hose (not shown) connected to a plug 19 which is integral with the fixed iron core 12 through a strainer 20. When the solenoid coil 11 is excited in this condition, the armature 15 is attracted by the fixed iron core 12 against the force of the return spring 17 so that the flange 6 of the valve 4 is in contact with the retainer 2 to open the injection port 5, and the fuel from the fuel supplier hose passes through a clearance defined between the end surface 13 of the iron core 12 and the armature 15 to be injected from the injection port 5.

Figure 2:
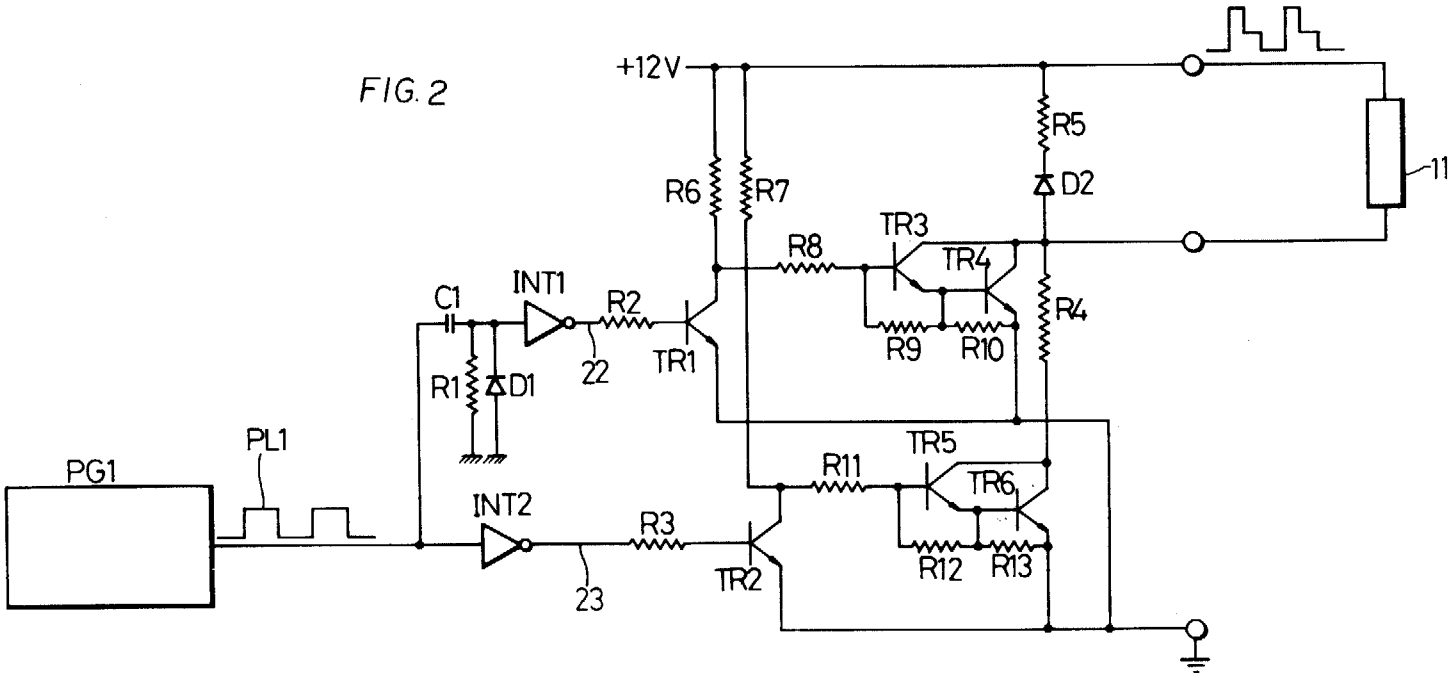
FIG. 2 is an electrical circuit of the apparatus of FIG. 1.
Figure 3:
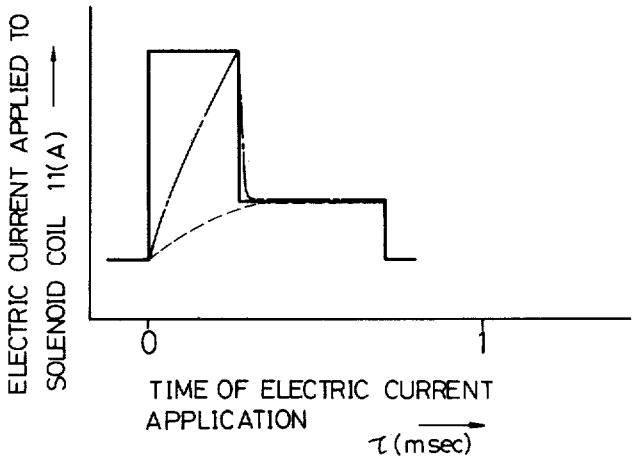
FIG. 3 is a performance chart of the apparatus of FIG. 1.

FIG. 2 shows an electric circuit for changing the rectangular-shaped pulse of an electric current applied to the solenoid coil 11 in response to the volume of the fuel supplied to the engine to a stepped pulse as shown in solid lines in FIG. 3 under pure resistance load on the solenoid coil 11. A pulse PL1 from a pulse generator PG1 generating the pulse upon injection of the fuel by the injector 21 is inputted in a circuit 22 of a transistor TR1 through a condenser C1, resistors R1 and R2, a diode D1 and an inverter INT1 and in a circuit 23 of a transistor TR2 through an inverter INT2 and a resistor R3. The solenoid coil 11 of the injector 21 is connected to a DC battery of which voltage is 12 V through transistors TR3 and TR4 which are connected with each other in Darlington circuit and which are under on-off control of the transistor TR1 of the circuit 22. The solenoid coil 11 is connected to the 12 V-DC battery also through transistors TR5 and TR6 which are connected with each other in Darlington circuit and which are under on-off control of the transistor TR2 of the circuit 23 and a current limiting resistor R4. Further, a circuit consisting of a surge absorbing resistor R5 and a diode D2 is connected to the solenoid coil 11 and resistors R6 to R13 as circuit elements are connected to the transistors TR1 to TR6.

When the pulse PL1 is not generated from the pulse generator PG1 in the above-constructed electric circuit, the solenoid coil 11 is not excited since the transistors TR1 and TR2 become on through inversion output of the inverters INT1 and INT2 by output zero of the pulse generator PG1 to make the transistors TR3 to TR6 off.

Then, when the pulse generator PG1 generates the pulse PL1 in response to the volume of the fuel to be injected from the injector 21, the inverter INT1 of the circuit 22 is inverted for a certain period determined by the condenser C1, the resistor R1 and threshold voltage of the inverter INT1 to turn zero after rise of the pulse PL1 and the inverter INT2 of the circuit 23 is inverted during the pulse length to turn zero. Therefore, the transistors TR3 and TR4 for controlling application of electric current to the solenoid coil 11 become on through the transistor TR1 during output inversion of the inverter INT1 and the transistors TR5 and TR6 become on through the transistor TR2 during output inversion of the inverter INT2. Since the resistor R4 for controlling electric current is connected in series to the transistors TR5 and TR6, an electric current having a stepped pulse shape as shown in solid lines in FIG. 3 is applied to the solenoid coil 11 granted that the same is pure resistance load. Namely, in the initial stage of the electric current application, a large amount of electric current is applied to the solenoid coil 11 to increase the attractive force of the armature 15 against the fuel pressure and the force of the return spring 17, and after the valve is fully shifted with the armature 15, the amount of the electric current applied to the solenoid coil 11 for maintaining the armature 15 in the shifted condition is reduced.

Figure 4:
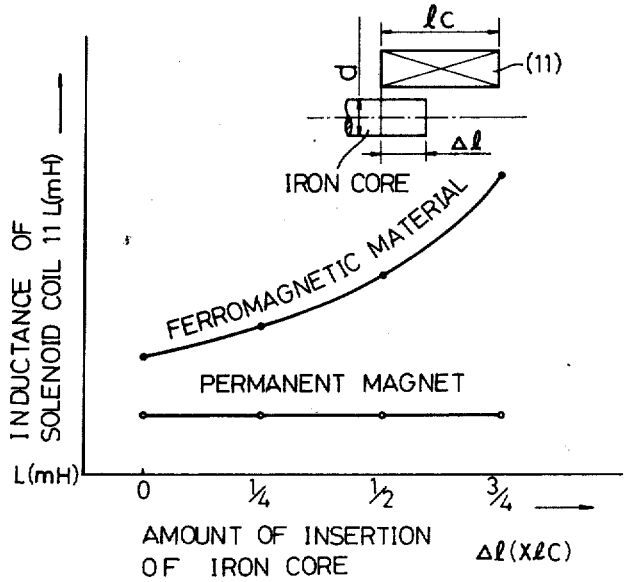
FIG. 4 is a graph showing comparison of characteristics of the solenoid coil with respect to different materials.

However, if the transistors TR3 to TR6 are subjected to on-off control according to the pulse shape as shown in FIG. 3, the actual electric current applied to the solenoid coil 11 does not form the pulse shape as shown in FIG. 3 since the solenoid coil 11 is not in fact pure resistance. FIG. 4 shows the result of comparison made on inductance of the solenoid coil 11 which is varied by insertion of the iron core in the effective length of the solenoid coil 11 with respect to a non-magnetized ferromagnetic material and with respect to a permanent magnet. As shown in FIG. 4, the inductance is relatively large and is increased in proportion to insertion amount in case of the non-magnetized ferromagnetic material while the inductance in case of the permanent magnet is relatively small and is not influenced by the insertion amount.

When the armature 15 of the embodiment shown in the drawings is experimentally made of a non-magnetized ferromagnetic material and the electric current to be applied to the solenoid coil 11 is controlled in accordance with the pulse shape as shown in the solid line in FIG. 3, the actual electric current flows in the shape as shown in phantom line in FIG. 3 because the inductance of the solenoid coil 11 is large. Consequently, attraction force for the armature 15 in the initial stage of the electric current application becomes insufficient leading to insufficient fuel control by the injector 21, and even if the current limiting the resistor R4 is removed from the electric circuit of FIG. 2 to make the electric current in the rectangular shape corresponding to the initial electric current as shown in the solid line in FIG. 3, measuring of the fuel by the injector 21 in small amount is limited because of the delay in attraction of the armature 15, and cannot follow the high-speed rotation of the engine.

Figure 5:
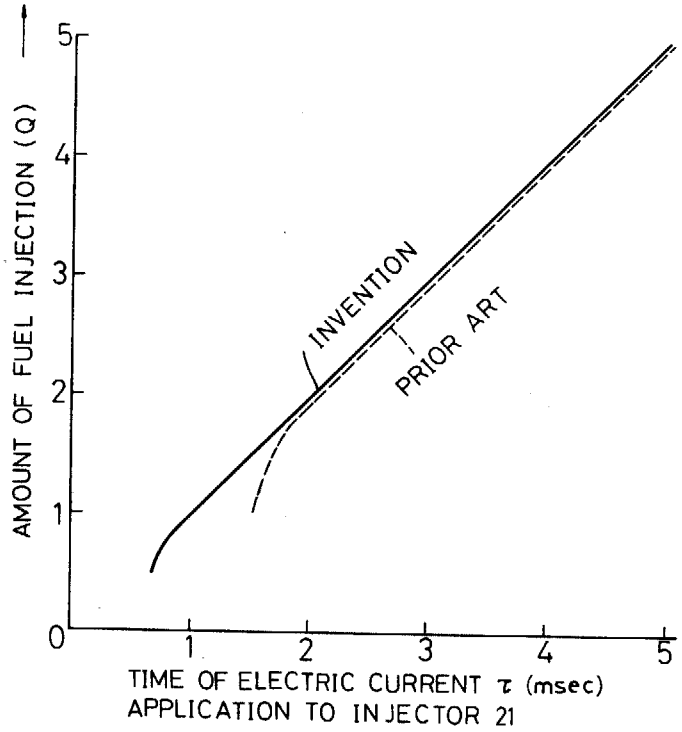
FIG. 5 is a graph showing comparison of characteristics of the injector of the present invention and a conventional injector.

However, since the armature 15 in the present invention is made of the permanent magnet, the inductance of the solenoid coil 11 becomes small and the solenoid coil 11 receives the electric current of which pulse shape is as indicated by one-dot line in FIG. 3 to sufficiently attract the armature 15 in the initial stage of the electric current application. After that, the electric current becomes small but maintains the armature 15 in attracted condition. In consequence, measurement of the injected fuel during high-speed engine rotation, which is most necessary for improving engine performance can be controlled even the time of the electric current application to the injector 21 is under 1 m sec as shown in solid line in FIG. 5. Namely, measurement of the fuel injected from the injector 21 while the electric current is applied below 2 m sec, which is the lowest limit of the prior art as shown in phantom line in FIG. 5, can be conducted and thereby the injector 21 can sufficiently follow the high-speed rotation of the engine.

Figure 6:
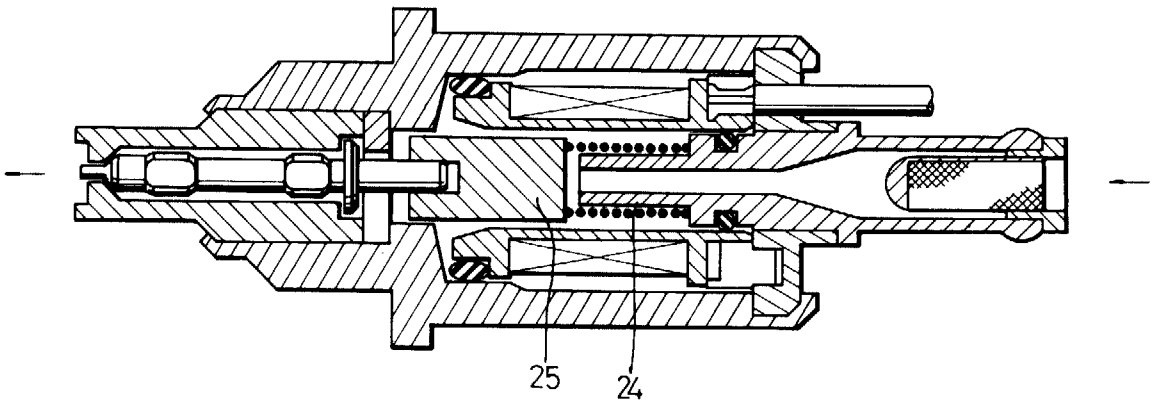
FIG. 6 is a longitudinal sectional view of a fuel injector to which a second embodiment of the present invention is applied.

FIG. 6 shows a second embodiment of the present invention, in which a fixed iron core 24 is sized to be smaller in length than the iron core 12 in the first embodiment and an armature 25 is sized to be larger in length than the armature 15 in the first embodiment so that the armature 25 is attracted by the fixed iron core 24 in a position in which the magnetic field shows the largest inclination on the axis of the solenoid coil 11. The other portions of the second embodiment are constructed identically with those of the first embodiment. Therefore, no further description of the second embodiment would be necessary to anyone of ordinary skill in the art.

Figure 7:
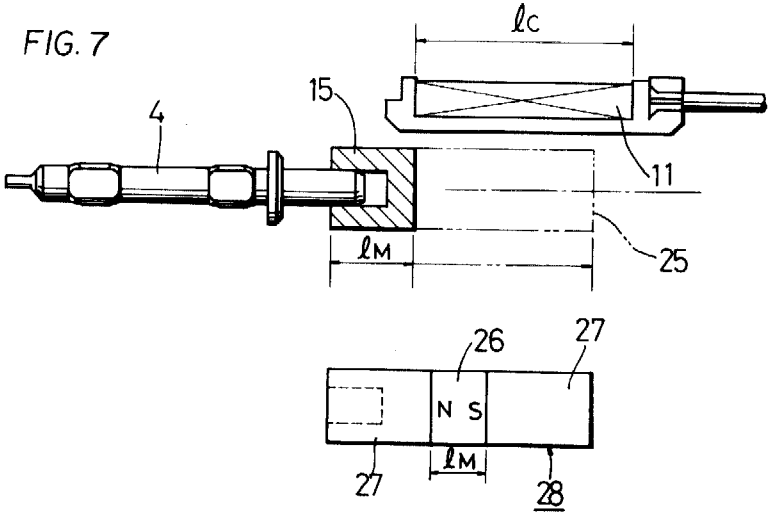
FIG. 7 is an illustrative view in which an armature of the second embodiment is provided in the form of a composite magnet.

In place of the lengthened armature 25 as shown in FIG. 6, a composite magnet 28 substantially identical in length with the magnet 25 may be utilized (see FIG. 7). The magnet 28 comprises a permanent magnet 26 which is identical in length with the armature 15 in FIG. 1 and a pair of soft magnetic materials 27 disposed on both ends of the magnet 26. This structure functions in the same way as the second embodiment.

Figure 8:
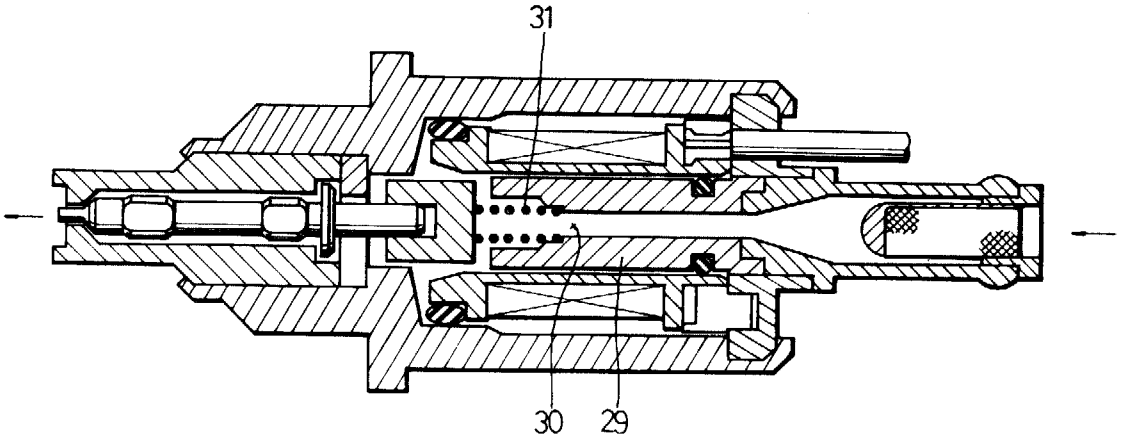
FIG. 8 is a longitudinal sectional view of a fuel injector to which a third embodiment of the present invention is applied.

FIG. 8 shows a third embodiment of the present invention, in which a passage 30 for the fuel formed in a fixed iron core 29 is sized large in inner diameter in the vicinity of the forward end of the fixed iron core 29 to make the inductance of the solenoid coil 11 small, and a return spring 31 is inserted into the passage 30 having the large inner diameter. The other portions of the third embodiment are constructed identically with those of the first embodiment. Therefore, no further description of the third embodiment would be necessary to anyone of ordinary skill in the art.

Though the armatures 15 and 25 are made of permanent magnets in the aforementioned embodiments, the fixed iron cores 12, 24 and 29 may be made of permanent magnets instead, or, both the armatures 15 and 25 and the fixed iron cores 12, 24 and 29 may be made of permanent magnets. Further, though the injector body 1 is made of nonmagnetic material, it may be made of a ferromagnetic material to function as a yoke for the solenoid coil 11 and make a magnetic path for the solenoid coil 11 with the armatures 15 and 25 and the fixed iron cores 12, 24 and 29.

Figure 9:
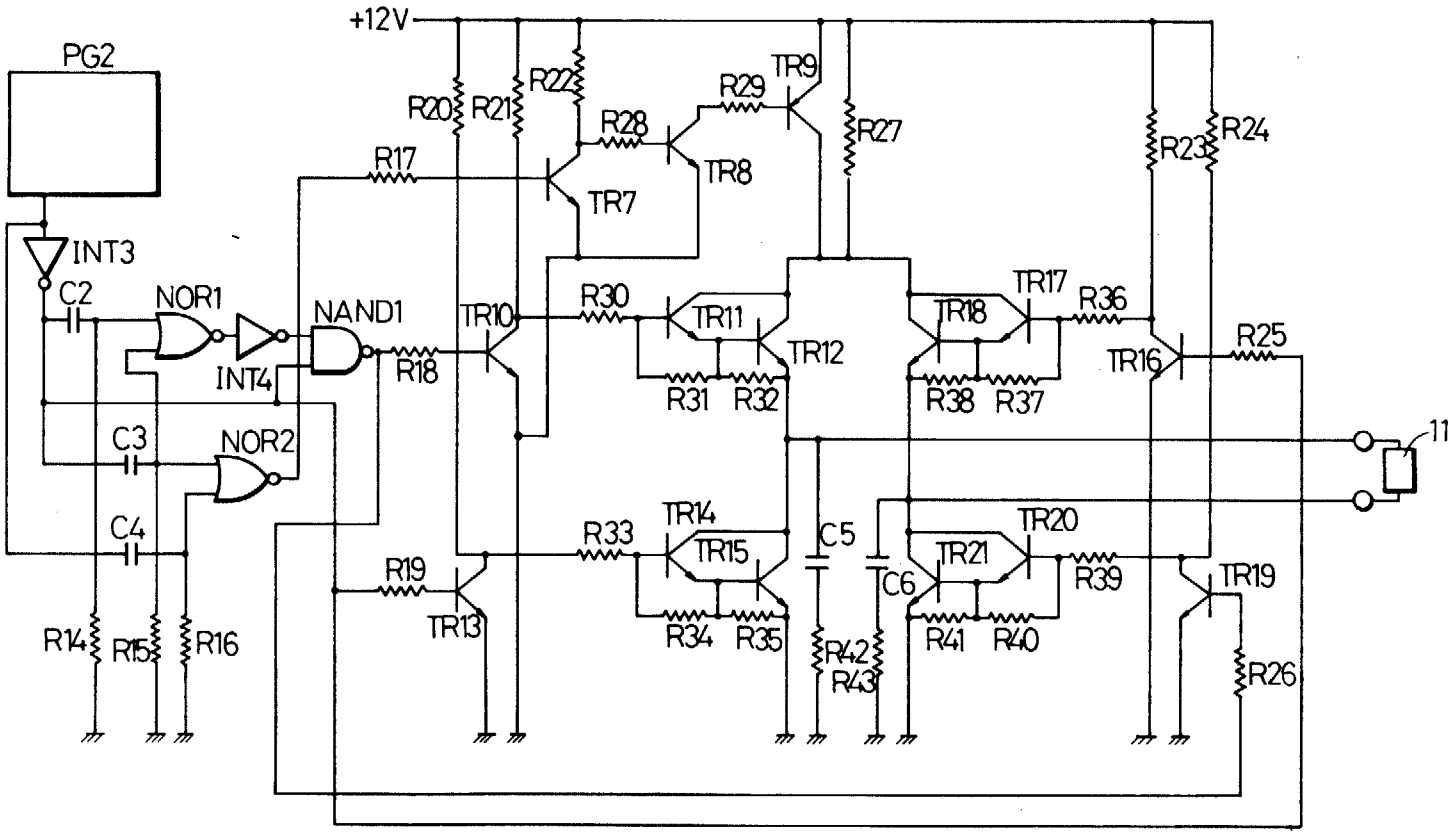
FIG. 9 is an electrical circuit of a fourth embodiment of the present invention.
Figure 10:
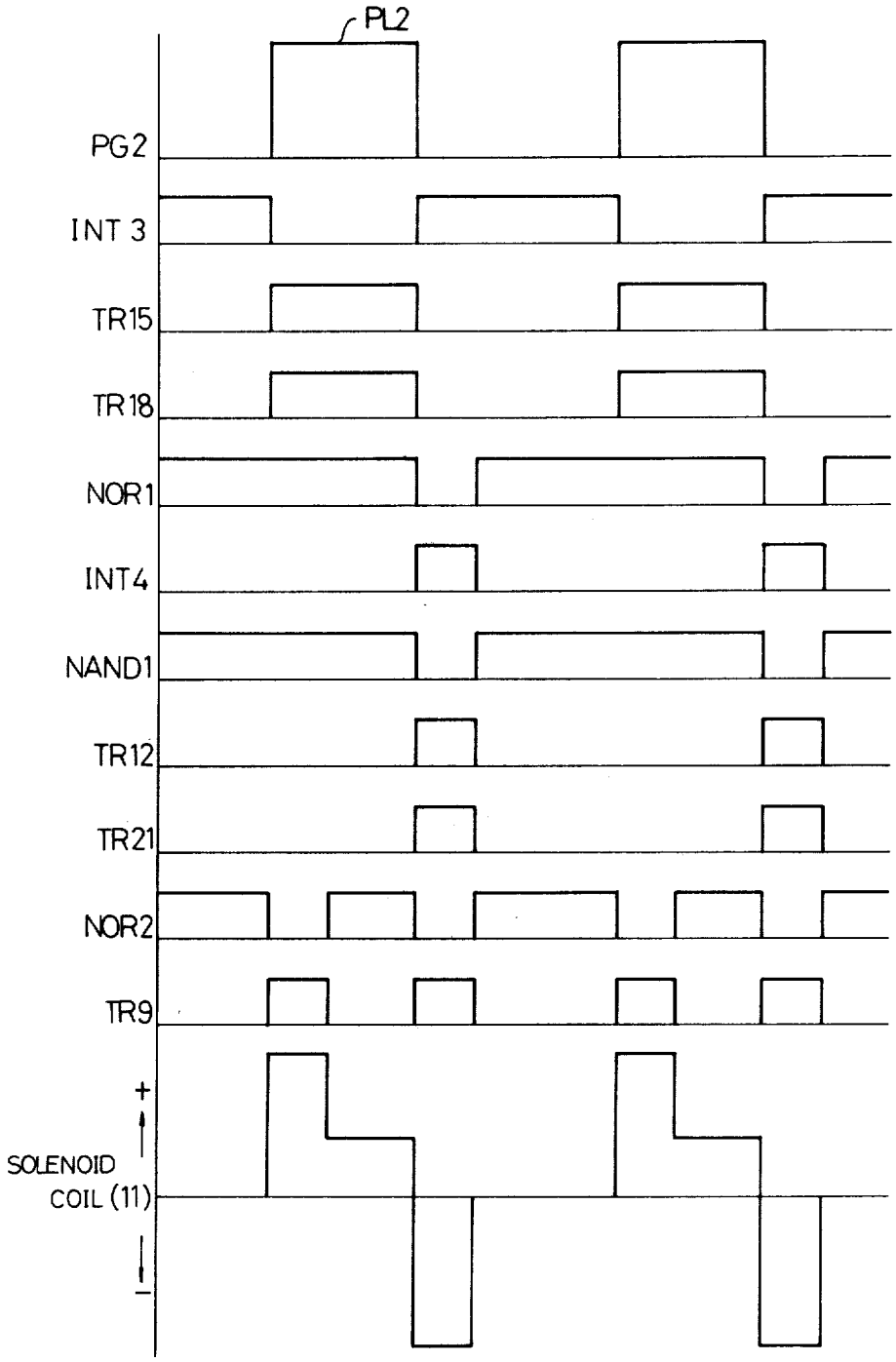
FIG. 10 is a performance chart of the fourth embodiment.
Figure 11:
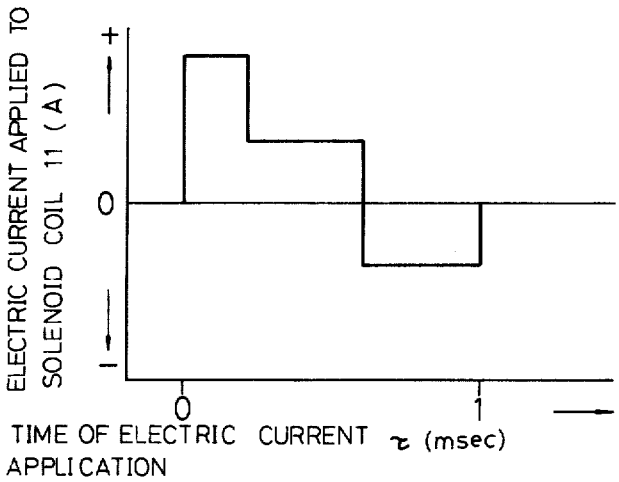
FIGS. 11 and 12 are graphs showing modifications of operational characteristics of the fourth embodiment.
Figure 12:
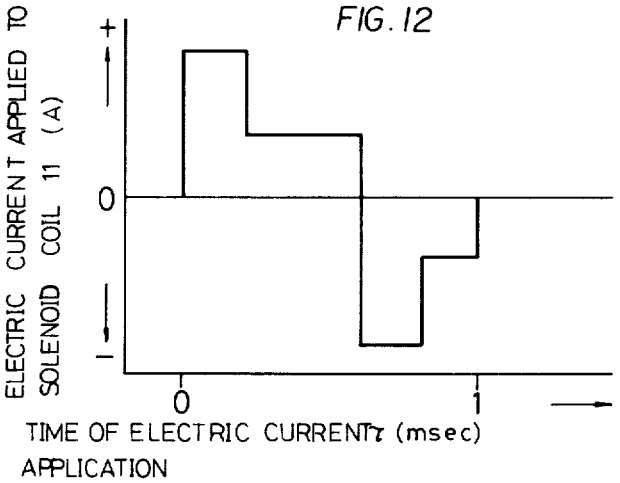

FIG. 9 shows a fourth embodiment of the present invention in which the shape of a pulse PL2 from a pulse generator PG2 to be sent to the solenoid coil 11 is changed in a stepped wave form through inverters INT3 and INT4, NOR circuits NOR1 and NOR2, a NAND circuit NAND1, transistors TR7 to TR21, resistors R14 to R43 and condensers C2 to C6. In this case, an inverse exciting current is applied to the solenoid coil 11 of the injector 21 in the first to the third embodiments upon fall of the pulse PL2 from the pulse generator PG2 to make end polarity of the fixed iron cores 12, 24 and 29 identical with that of the armatures 15 and 25 so that repulsive force is generated in the armatures 15 and 25, and thereby raise return characteristics of the valve 4 upon fall of the pulse PL2 and improve response of the injector 21 so that the valve certainly returns even if the flange 6 of the valve 4 bites into the retainer 2 and valve 4 cannot be returned by the force of the return springs 17 and 31 by some mechanical accident to prevent the injector 21 from abnormal condition.

While the invention has been described with reference to a few preferred embodiments thereof, it is to be understood that modifications or variations may be easily made without departing from the scope of this invention which is defined by the appended claims.

What is claimed is:

1. In a fuel injector for an internal combustion engine including a cylindrical valve housing provided with an injection port at its forward end, a valve body fixed on the rear outer periphery of said valve housing and extending rearwardly from said valve housing, a rod-like valve member accommodated in said valve housing and adapted to reciprocate axially, a solenoid coil provided and arranged rearwardly from said valve housing, a fixed iron core accommodated within said solenoid coil and fixed to said valve body, said fixed iron core being arranged coaxially with said valve member, an armature facing towards said fixed iron core with a clearance normally defined between itself and said fixed iron core, mechanical biasing means interposed between said armature and said fixed iron core, said valve member being movable in respective axial directions by respectively conducting or cutting off an electric current to said solenoid coil and respectively opening or closing said injection port of said valve housing at its forward end to intermittently inject fuel through said port; an improvement wherein at least one of said armature secured to said valve member and said fixed iron core is made of a permanent magnet, and including circuit means, coupled to said solenoid coil, for producing a pulse shape of the electric current applied to said solenoid coil of said fuel injector in a stepped wave shape, the electric current in an initial stage of current application being larger than that in a later stage.

2. The fuel injector as defined in claim 1 wherein one said armature of said fixed iron core is made of a composite magnet comprising a permanent magnet and a ferromagnetic material.

3. The fuel injector as defined in claims 1 or 2 wherein both said armature and said fixed iron core are formed from a permanent magnet material.

4. The fuel injector as defined in claim 3 wherein said valve body is made of a non-magnetic material.

5. The fuel injector as defined in claim 1 wherein said circuit means produces as the stepped wave a step wave having a initial stage of current application of given polarity larger than a later stage of current application of said given polarity and a still later stage of current application of polarity opposite said given polarity.

* * * * *